United States Patent [19]

Yamaji

[11] Patent Number: 5,039,241

[45] Date of Patent: Aug. 13, 1991

[54] RIBBON SHIFTER WITH IMPACT OF CHARACTER CENTER ON RIBBON CENTER

[75] Inventor: Koji Yamaji, Yamatokoriyama, Japan

[73] Assignee: Sharp Kabushiki Kaisha, Osaka, Japan

[21] Appl. No.: 511,959

[22] Filed: Apr. 17, 1990

Related U.S. Application Data

[63] Continuation of Ser. No. 280,366, Dec. 6, 1988, abandoned.

[30] Foreign Application Priority Data

Dec. 7, 1987 [JP] Japan ..... 62-186745[U]

[51] Int. Cl.[5] ..... B41J 35/10

[52] U.S. Cl. ..... 400/216.2; 400/212

[58] Field of Search ..... 400/211-216.6

[56] References Cited

U.S. PATENT DOCUMENTS

| | | | |
|---|---|---|---|
| 4,563,100 | 1/1986 | Hamamichi | 400/216.1 |
| 4,605,324 | 8/1986 | Musso | 400/212 |
| 4,611,938 | 9/1986 | Rettke | 400/212 |
| 4,787,763 | 11/1988 | Kondo | 400/212 |

FOREIGN PATENT DOCUMENTS

| | | | |
|---|---|---|---|
| 160832 | 11/1985 | European Pat. Off. | 400/213 |
| 56-42678 | 4/1981 | Japan . | |
| 67288 | 6/1981 | Japan | 400/213 |
| 144992 | 11/1981 | Japan | 400/212 |
| 56-162684 | 12/1981 | Japan . | |
| 97878 | 5/1987 | Japan | 400/216.2 |
| 244686 | 10/1987 | Japan | 400/212 |

*Primary Examiner*—David A. Wiecking
*Assistant Examiner*—Steven S. Kelley

[57] ABSTRACT

A printer employs an ink ribbon in the form of a tape and is provided with a control system for judging proper printing positions of characters to be printed within respective printing ranges and for determining the relative position of the ink ribbon with respect to a printing head and a stepping motor for shifting the ink ribbon in a direction widthwise of the ink ribbon in response to signals from the control system so that printing is performed utilizing only the center portion of the ink ribbon regardless of the character or symbol being printed.

12 Claims, 7 Drawing Sheets

RIBBON SHIFTER WITH IMPACT OF CHARACTER CENTER ON RIBBON CENTER

This application is a continuation of application Ser. No. 280,366 filed on Dec. 6, 1988, now abandoned.

BACKGROUND OF THE INVENTION

1. Field of the Invention

The present invention relates to a printer employing therein an ink ribbon in the form of a tape.

2. Description of the Prior Art

Conventionally, in a printer to be used as a peripheral device of an electronic typewriter or a word processor, the positional relationship between a printing head and an ink ribbon is generally set unchanged.

When one or more letters, symbols and the like, for example, a string of characters ""Ay_" are printed on a paper using such a printer, the ink ribbon 01 is used as shown in FIGS. 1*a* to 1*d*. In this example, a daisy wheel is used as the printing head.

A double quotation mark "" is located at an upper portion of one of the printing type pieces 02 of the daisy wheel. Accordingly, only an upper portion of the ink ribbon 01 is used, as shown in FIG. 1*a*. As a capital letter "A" is located at the center of a type piece 02, only the middle portion of the ink ribbon 01 is used, as shown in FIG. 1*b*. As a small letter "y" is located at a lower half of a type piece 02, only a lower half of the ink ribbon 01 is used, as shown in FIG. 1*c*. Furthermore, an underline "_" is located near the lower end of a type piece 02, so that only a portion near the lower end of the ink ribbon 01 is used, as shown in FIG. 1*d*.

FIG. 2 indicates how the ink ribbon 01 was used, resulting in printing marks which are completely identical with the printed condition on the paper. In other words, letters are printed using substantially the middle portion of the ink ribbon 01 whereas symbols are done using only the upper and lower portions of the ink ribbon 01. Accordingly, in the conventional printers, the letters and symbols can not be properly printed unless the ink ribbon 01 has a width h1 greater than a size obtained by adding a width required for printing all of the possible symbols required for printing the letters.

Because of this, users are obliged to use a relatively wide and expensive ribbon in the conventional printers rather than a relatively narrow and inexpensive ink ribbon.

Some of the conventional printers are capable of printing three lines at a time. Such printers, hereinafter referred to as three-line printers, do not require an ink ribbon having a width three times greater than the width h1 of the ink ribbon used for printing line by line but require an ink ribbon having a width h3 at least about two times greater than the latter, since upper and lower margins of the ink ribbon can be omitted. The three-line printers are controlled with respect to every three lines so as to print character by character in a direction of feed of a printing paper. To this end, the printing paper is fed line by line along with the ink ribbon so that the relative position of the ink ribbon may be shifted with respect to the printing head. FIG. 3 indicates printing marks formed on the ink ribbon 01 in a certain three-line printer. As is clear from the printing marks of FIG. 3, the three-line printers also can not employ a relatively narrow and inexpensive ink ribbon.

SUMMARY OF THE INVENTION

Accordingly, the present invention has been developed with a view to substantially eliminating the above described disadvantage inherent in the prior art printer, and has for its essential object to provide an improved printer which is capable of properly printing using a relatively narrow and inexpensive ink ribbon.

Another important object of the present invention is to provide a printer of the above described type which is stable in functioning and can be readily manufactured at a low cost.

In accomplishing these and other objects, the printer according to one preferred embodiment of the present invention is of the construction shown in FIG. 4.

More specifically, the printer of the present invention employs an ink ribbon 1 in the form of a tape and is provided with a judging means 2 for judging proper printing positions of characters to be printed within respective printing ranges on the basis of printing data, a determining means 4 for determining the relative position of the ink ribbon 1 with respect to a printing head 3 on the basis of judging signals sent from the judging means 2, and a shifting means 5 for shifting the ink ribbon 1 in a direction widthwise of the ink ribbon 1 in response to determining signals sent from the determining means 4 wherein only the widthwise center portion of the ink ribbon is used for all possible printed characters.

In FIG. 4, reference numerals 6 and 7 designate a recording paper and a platen, respectively.

In this printer, the printing data are initially supplied to the judging means 2 and to the printing head 3 so that the judging means 2 may judge the proper printing positions of characters to be printed within respective printing ranges on the basis of the printing data. The determining means 4 then determines the relative position of the ink ribbon 1 with respect to the printing head 3 on the basis of the judging signals from the judging means 2. The shifting means 5 shifts the ink ribbon 1 in a direction widthwise of the ink ribbon 1 with respect to the printing head 3 on the basis of the determining signals from the determining means 4. In this way, the positional relationship between the ink ribbon 1 and the printing head 3 is changed so that only a portion of and near the widthwise center of the ink ribbon 1 may be used in printing any one of all possible characters. In other words, the relative position of the ink ribbon 1 with respect to the printing head 3 in printing letters differs from that in printing special symbols.

Thus, the printer according to the present invention is capable of properly printing using the ink ribbon 1 which is narrower than an ink ribbon being used in the conventional printer.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and in which.

DETAILED DESCRIPTION OF THE PREFERRED EMBODIMENT

Figure 5:
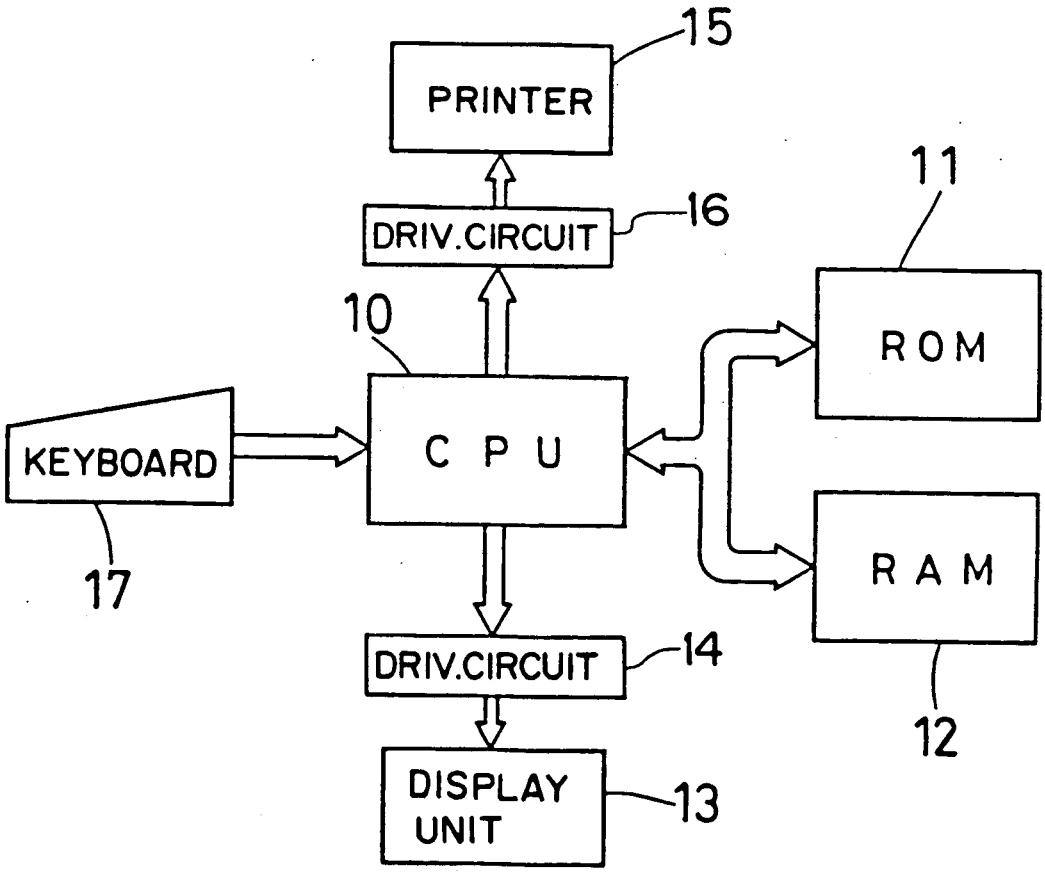
FIG. 5 is a block diagram of an electronic typewriter equipped with the printer of the present invention.

FIG. 5 is a block diagram of an electronic typewriter equipped with a printer according to the present invention.

In FIG. 5, reference numeral 10 designates a CPU (Central Processing Unit). Reference numerals 11 and 12 designate a ROM (Read Only Memory) and a RAM (Random Access Memory), respectively. In the ROM 11 are stored various processing programs, data D1 indicative of character printing positions during the printing, data D2 indicative of the position of an ink ribbon 1 with respect to a printing head 3 and the like. The position of the ink ribbon 1 differs according to characters to be printed. The RAM 12 has an area for storing therein semi-fixed data, for example, tabs and the like and an area for storing therein text to be produced. Reference numeral 13 designates a display unit for generating a display on the basis of printing signals sent from the CPU 10 through a driving circuit 14. Reference numeral 15 designates a printer for printing on the basis of printing signals sent from the CPU 10 through another driving circuit 16. Reference numeral 17 designates a keyboard used as an input means.

Figure 6:
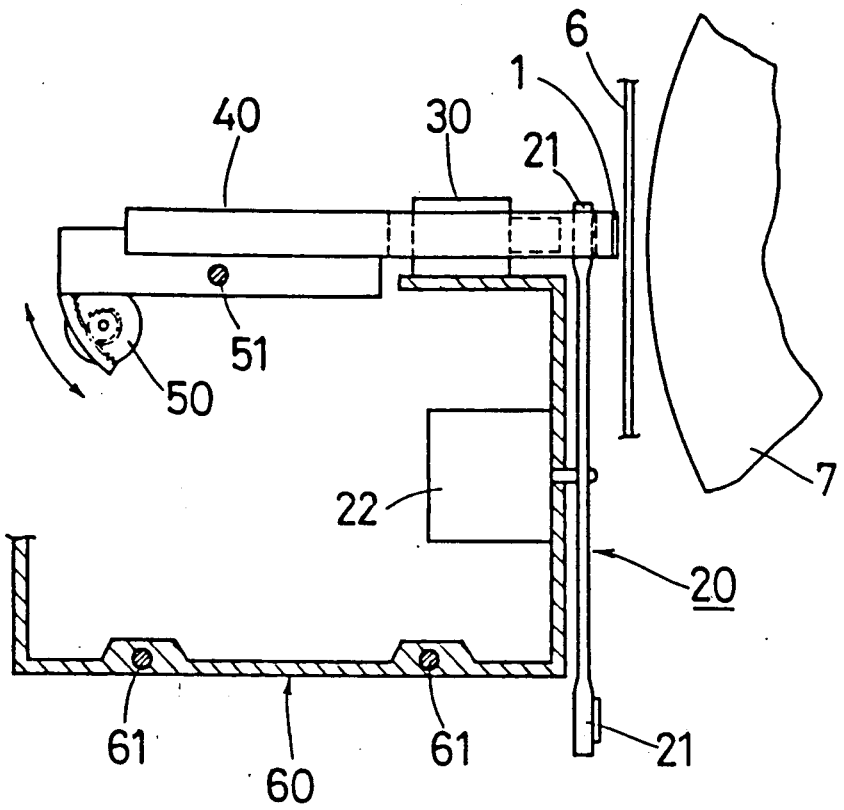
FIG. 6 is a fragmentary side elevational view, partly in section, indicative of the construction of the printer of FIG. 4.

FIG. 6 depicts the construction of the printer according to the present invention.

The printer is provided with a cylindrical platen 7, a daisy wheel 20 having a plurality of printing type pieces 21 on its periphery, an electric motor 22 drivingly coupled to the daisy wheel 20, a hammer unit 30 for striking the type pieces 21 one at a time against the platen 7, a ribbon cartridge 40 accommodating the ink ribbon 1 and a stepping motor 50 for pivoting the ribbon cartridge 40 about a pivot shaft 51 in a direction shown by an arrow. The stepping motor 50 is employed as a shifting means for shifting the position of the ink ribbon 1 with respect to the daisy wheel 20 according to respective type pieces 21. These members are mounted on a support carrier 60 which is driven by a certain driving mechanism (not shown) and is freely movable along a pair of guide rods 61 disposed in parallel with the platen 7.

Figure 1B:
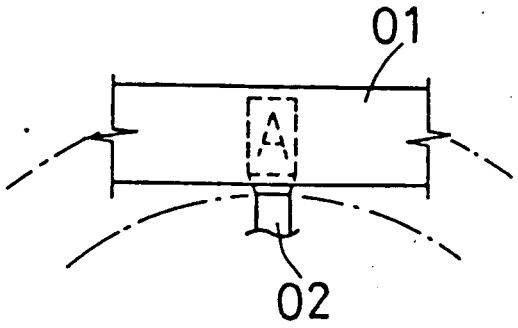
FIGS. 1*a* to 1*d* are fragmentary elevational views indicative of the positional relationship between an ink ribbon and printing type pieces in a conventional printer.
Figure 1A:
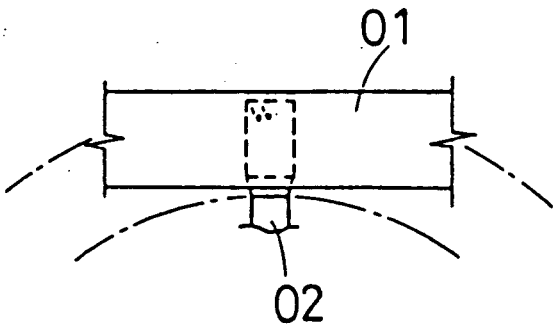
Figure 1C:
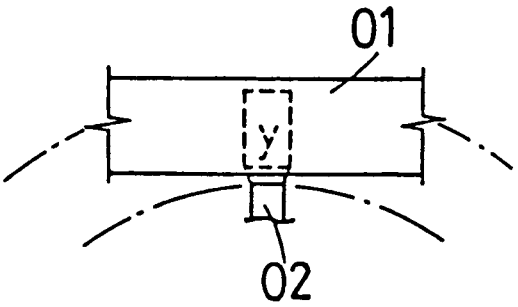
Figure 1D:
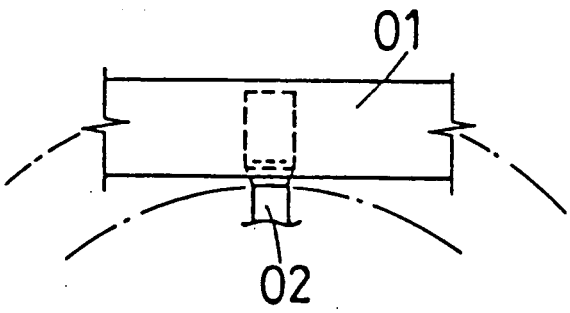
Figure 2:
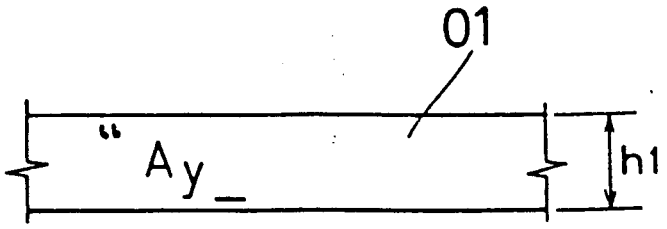
Fig. 2 PRIOR ART
FIG. 2 is a view explanatory of printing marks formed on the ink ribbon which was used in the conventional printer.
Figure 3:
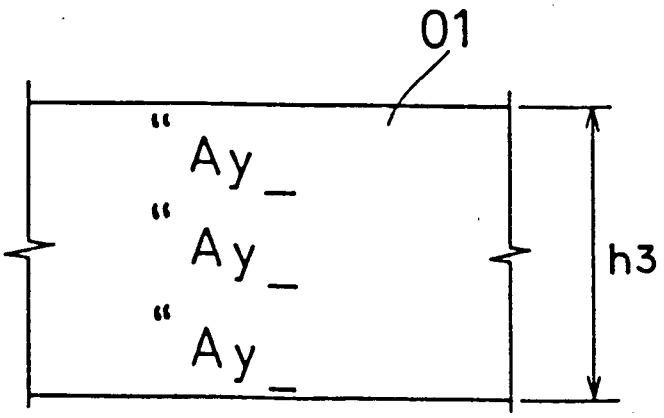
Fig. 3 PRIOR ART
FIG. 3 is a view similar to FIG. 2, which particularly shows the printing marks formed on a relatively wide ink ribbon which was used in a conventional three-line printer.
Figure 4:
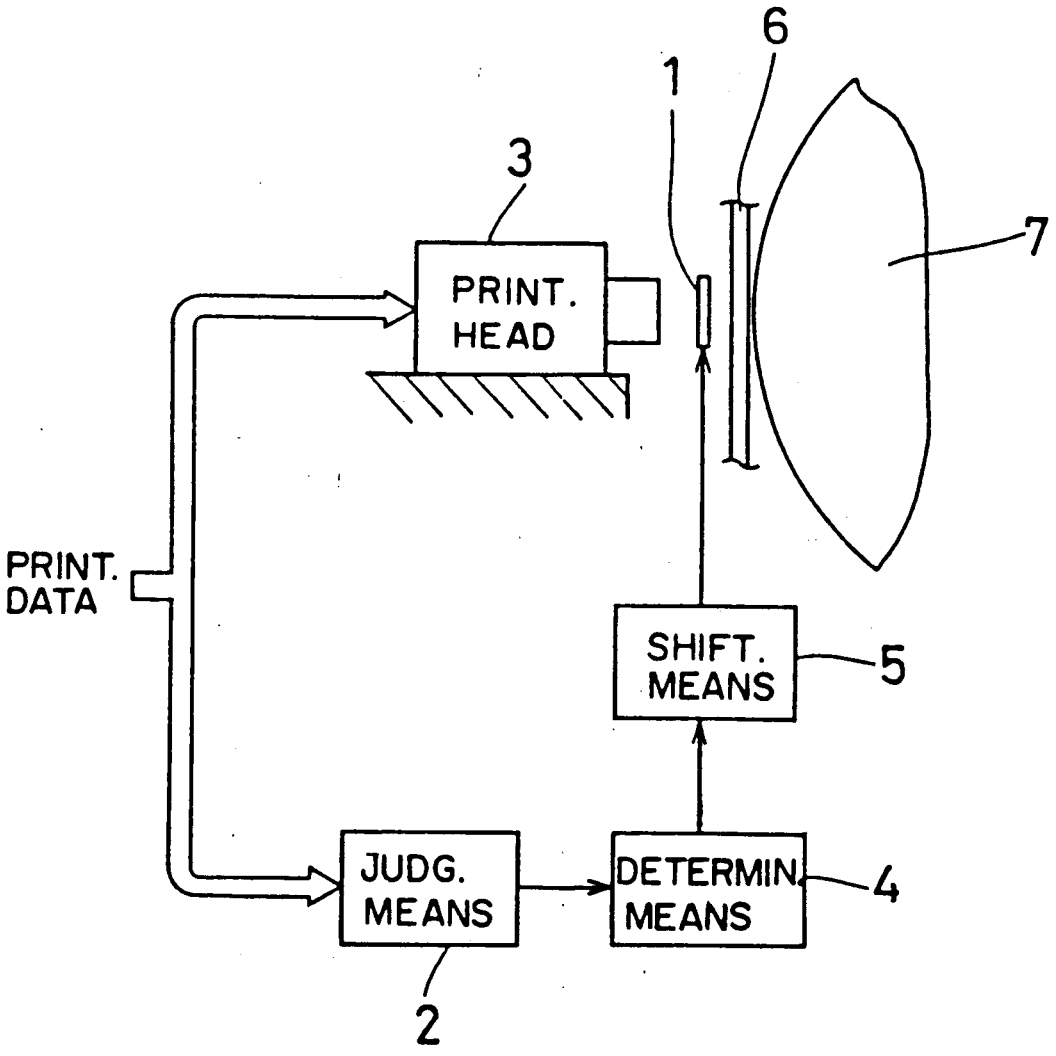
FIG. 4 is a block diagram of a printer according to the present invention.

In this embodiment, the daisy wheel 20 and the hammer unit 30 correspond to the printing head 3 shown in FIG. 4.

A width h2 of the ink ribbon 1 used in this embodiment is substantially equal to or slightly greater than alphabetical types of capital letters. This width h2 is, therefore, smaller than the width h1 of the conventional ink ribbon.

When the relatively narrow ink ribbon 1 is employed in the conventional printer in which the relative position between the ink ribbon and the printing head is fixed, such characters as "“", "_", "y" etc. can not be printed properly. The reason for this is that these characters are offset from the center of respective type pieces 21 of the daisy wheel 20 and jut out of the ink ribbon 1. Accordingly, the printer of the present invention is of the construction in which the relative position of the ink ribbon 1 with respect to the type pieces 21 of the daisy wheel 20 varies so that none of the letters and symbols may jut out of the ink ribbon 1.

The printer of the present invention operates as follows.

When the CPU 10 receives the printing data, the CPU 10 initially reads from the ROM 11 both the data D1 and data D2 corresponding to letters and symbols to be printed. Then, a judging means 2 provided in the CPU 10 judges the proper printing positions of the characters, which differ according to alphabets of capital and lower case letters and symbols while a determining means 4 provided in the CPU 10 determines the relative position of the ink ribbon 1 with respect to the type pieces 21 of the daisy wheel 20.

Determining signals given by the determining means 4 drive the stepping motor 50 for proper printing so that the position of the ink ribbon 1 may be shifted with respect to the type pieces 21 of the daisy wheel 20 by pivoting the ink ribbon 1 about the pivot shaft 51.

The amount of shift of the ink ribbon 1 is required to be changeable with respect to each character to be printed.

Figure 8A:
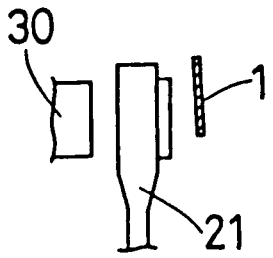
FIGS. 8*a* to 8*c* are fragmentary side elevational views indicative of the positional relationship between the ink ribbon and the printing type pieces in the printer of FIG. 4.
Figure 8B:
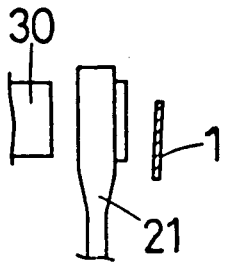
Figure 8C:
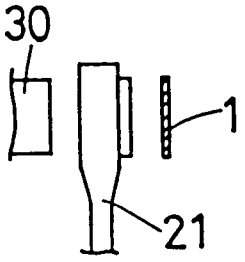
Figure 7B:
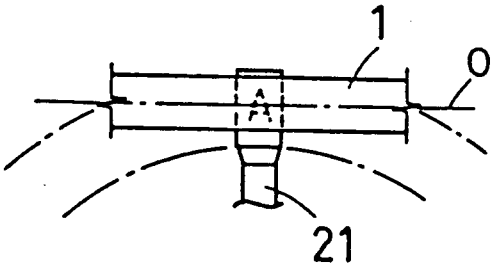
FIGS. 7*a* to 7*d* are fragmentary elevational views indicative of the positional relationship between the ink ribbon and printing type pieces in the printer of FIG. 4.
Figure 7A:
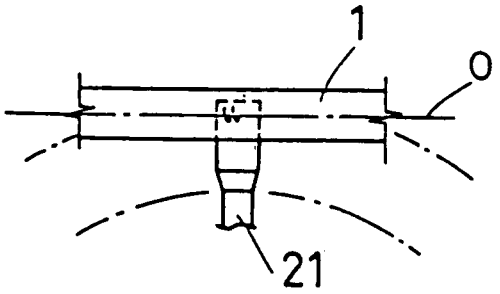
Figure 7C:
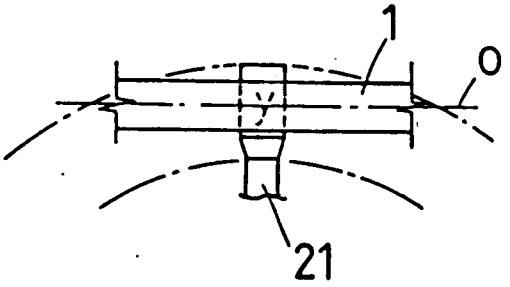
Figure 7D:
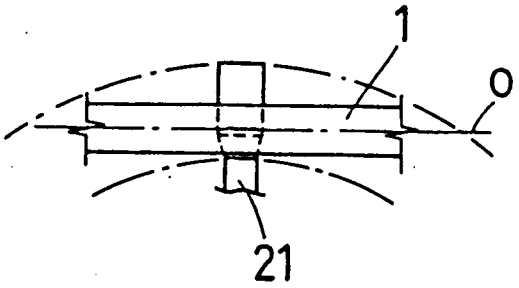

FIGS. 7 and 8 depict various shifted conditions of the ink ribbon 1 when a string of characters ""Ay_" are successively printed. As the double quotation mark "“" is located at an upper portion of one of the type pieces 21 of the daisy wheel 20, the ink ribbon 1 is caused to shift upwards, as shown in FIGS. 7*a* and 8*a*, so that this mark may confront the center of the ink ribbon 1. When the capital letter "A" is printed which is located at the center of a type piece 21, the ink ribbon 1 is shifted downwards from the previous position, as shown in FIGS. 7*b* and 8*c* so that the center of the corresponding type piece 21 may locate on the center line O of the ink ribbon 1. When the lower case letter "y" is printed which is located offset from the center of and on a lower half of a type piece 21, the ink ribbon 1 is caused to further shift downwards, as shown in FIGS. 7*c* and 8*b*, so that the center of this letter may locate on the center line O of the ink ribbon 1. Likewise, as the underline "_" is located near the lower end of a type piece 21, the ink ribbon 1 is shifted further downwards from the previous position, as shown in FIG. 7*d*.

Figure 9:
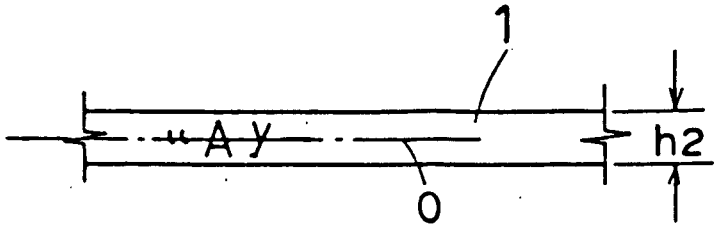
FIG. 9 is a fragmentary view indicative of printing marks formed on the ink ribbon which was used in the printer of FIG. 4.
Figure 10:
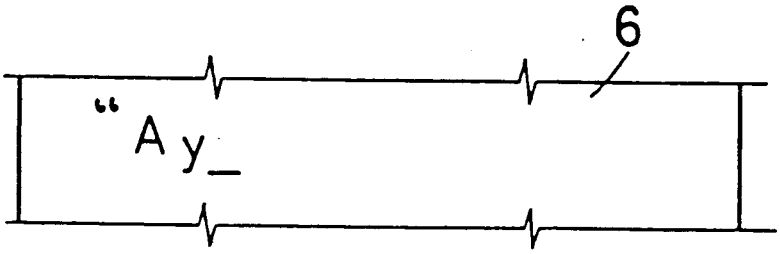
FIG. 10 is a fragmentary view indicative of a printed recording paper.

In this way, since all of the characters are printed using generally the center of the ink ribbon 1, the printing marks are aligned on the center line O of the ink ribbon, as shown in FIG. 9. This fact enables the ink ribbon 1 employed in the printer of the present invention to be narrower than a length of a recording paper 6 required for one-line printing shown in FIG. 10.

As described above, since the printing control is done so that only the center of the ink ribbon 1 may be used regardless of letters and symbols being printed, the printer of the present invention can employ the ink ribbon 1 which is narrower and less expensive than an ink ribbon-for use in the conventional printer, without lowering the printing quality. The relatively inexpensive ink ribbon 1 is greatly conducive to the reduction of user's cost.

Figure 11:
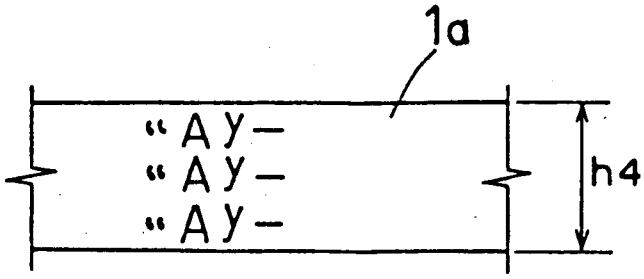
FIG. 11 is a fragmentary view indicative of printing marks formed on the ink ribbon which was used in the three-line printer according to another embodiment of the present invention.

When the printer according to the present invention employs, for example, the three-line printing, the ink ribbon 1*a* can be used more effectively by changing the amount of shift of the ink ribbon 1*a* according to characters to be printed. Accordingly, as shown in FIG. 11, a width h4 of the ink ribbon 1*a* can be narrowed, as compared with the width h3 of the ink ribbon used in the conventional three-line printer. When the ink ribbon having the same width h3 as that used in the conventional three-line printer is employed in the printer of the present invention, the number of printing lines on the ink ribbon can be increased, resulting in a reduced printing cost for each character.

It is to be noted here that although the printer in this embodiment employs the daisy wheel, the present invention is applicable to any other printers of the type in which an ink ribbon in the form of a tape is used, for example, printers having a thermal head or a dot matrix head.

From the foregoing, according to the present invention, only the center of the ink ribbon is used for printing regardless of letters and symbols utilized by changing the relative position of the ink ribbon with respect to respective characters to be printed. The printing can be properly done using an ink ribbon which is narrower and less expensive than that used in the conventional printer, thus resulting in a reduced cost of consumables.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A printer having a printing head and employing therein an ink ribbon in the form of a tape, said printer comprising:

means for inputting printing data into said printer;

judging means for judging normal printing positions of characters to be printed within respective printing ranges on the basis of said printing data and outputting judging signals representative thereof, wherein each character to be printed has a predetermined center of print defining a character center line with respect to an overall height of said character;

determining means for determining a center line of the ink ribbon with respect to the printing head on the basis of the judging means and outputting determining signals representative thereof;

shifting means for shifting the ink ribbon in a direction widthwise of the ink ribbon by a predetermined amount in response to the determining signals output by said determining means, wherein said predetermined amount is an amount by which said ink ribbon is vertically adjusted thereby enabling said center line for each of said printed characters to be positioned coincident with said center line of the ink ribbon; and printing means for causing each character to print using the ink ribbon such that the ink ribbon center line is coincident with said character center line.

2. The printer according to claim 1, wherein said shifting means comprises a stepping motor.

3. The printer according to claim 1, wherein an overall ribbon width is equal to an alphabetical type of capital letter.

4. The printer according to claim 1, wherein an overall ribbon width is substantially equal to an alphabetical type of capital letter.

5. A printer having a printing head and employing therein an ink ribbon in the form of a tape having a predetermined widthwise center line, said printer comprising:

means for inputting printing data into said printer;

judging means for judging normal printing positions of characters to be printed within respective printing ranges on the basis of said printing data and outputting judging signals representative thereof, wherein each character to be printed has a predetermined center of print defining a character center line with respect to an overall height of said character;

determining means, responsive to said judging means, for determining for each character a predetermined amount of widthwise shift requested for said ink ribbon such that each said character center line is coincident with the center line of the ink ribbon;

shifting means of shifting the ink ribbon in a direction widthwise of the ink ribbon by said predetermined amount for each of said characters to be printed; and printing means for causing each character to print using the ink ribbon such that the ink ribbon center line is coincident with said character center line.

6. The printer according to claim 5, wherein said shifting means comprises a stepping motor.

7. The printer according to claim 5, wherein an overall ribbon width is equal to an alphabetical type of capital letter.

8. The printer according to claim 5, wherein an overall ribbon width is substantially equal to an alphabetical type of capital letter.

9. A printer having a printing head and employing therein an ink ribbon in the form of a tape, said printer comprising:

means for inputting printing data into said printer;

judging means for judging normal printing positions of characters to be printed within respective printing ranges on the basis of said printing data and outputting judging signals representative thereof, wherein each character to be printed has a predetermined center of print defining a character center line with respect to an overall height of said character;

determining means, responsive to said judging means, for determining for each character a predetermined amount of widthwise shift required for said ink ribbon such that each said character center line is coincident with a center line of the ink ribbon width;

shifting means for shifting the ink ribbon in a widthwise direction by said predetermined amount for each of said characters to be printed; and printing means for causing each character to print using the ink ribbon such that the ink ribbon center line is coincident with said character center line.

10. The printer according to claim 9, wherein said shifting means comprises a stepping motor.

11. The printer according to claim 9, wherein an overall ribbon width is equal to an alphabetical type of capital letter.

12. The printer according to claim 9, wherein an overall ribbon width is substantially equal to an alphabetical type of capital letter.

* * * * *